United States Patent [19]

Angelo, II

[11] Patent Number: 4,934,931

[45] **Date of Patent: * Jun. 19, 1990**

[54] CYCLONIC COMBUSTION DEVICE WITH SORBENT INJECTION

[76] Inventor: James F. Angelo, II, 3416 I. St., Little Rock, Ark. 72205

[ * ] Notice: The portion of the term of this patent subsequent to Mar. 29, 2005 has been disclaimed.

[21] Appl. No.: 329,268

[22] Filed: Mar. 27, 1989

Related U.S. Application Data

[63] Continuation-in-part of Ser. No. 66,315, Jun. 5, 1987, abandoned.

[51] Int. Cl.[5] ..... F27B 7/36

[52] U.S. Cl. ..... 432/105; 110/263; 110/246; 432/111; 432/113; 432/114; 432/117

[58] Field of Search ..... 432/105, 111, 113, 114, 432/117; 110/246, 263

[56] References Cited

U.S. PATENT DOCUMENTS

| | | | |
|---|---|---|---|
| 1,706,592 | 3/1929 | Ryder | 432/117 |
| 2,187,922 | 1/1940 | West et al. | 432/111 |
| 2,850,273 | 9/1958 | Barnes | 432/117 |
| 3,279,892 | 10/1966 | Lessner et al. | 432/114 |
| 3,404,199 | 10/1968 | Hoffmann | 432/111 |
| 3,580,554 | 5/1971 | Bushuev | 432/117 |
| 3,842,762 | 10/1974 | Sargent et al. | 119/246 |
| 4,437,835 | 3/1984 | Martin | 432/113 |
| 4,462,793 | 7/1984 | Maeda et al. | 432/105 |
| 4,474,119 | 10/1984 | Jones | 110/263 |
| 4,476,790 | 10/1984 | Borio et al. | 110/263 |
| 4,551,051 | 11/1985 | Hofbauer et al. | 110/246 |
| 4,582,005 | 4/1986 | Brown | 110/263 |
| 4,734,166 | 3/1988 | Angelo | 432/105 |
| 4,834,648 | 5/1989 | Angelo | 432/105 |

*Primary Examiner*—Henry C. Yuen

*Attorney, Agent, or Firm*—Hovey, Williams, Timmons & Collins

[57] ABSTRACT

A combustion device for the pyrolytic destruction and gasification of industrial or other wastes, or lower sulfur fuels, is provided which includes an elongated cylindrical kiln body. Air is introduced into the kiln body by a plurality of pipes which define different combustion zones therewithin. A sorbent such as pulverized limestone may be introduced into each zone for reaction with the feedstock material to reduce undesirable flue emissions. The pipes are oriented within the kiln body to sweep the feedstock along the kiln body in a generally cyclonic pattern of torroidal shape and cross-sectional contour. The kiln may be rotated at various speeds corresponding to the force of the introduced combustion air to fluidize and entrain the feedstock material to be combusted.

9 Claims, 1 Drawing Sheet

CYCLONIC COMBUSTION DEVICE WITH SORBENT INJECTION

This application is a continuation-in-part of Ser, No. 07/066,315 filed June 5, 1987, now abandoned.

BACKGROUND OF THE INVENTION

1. Field of the Invention

This invention relates to new and useful improvements in combustion devices for the destruction by burning of industrial and other wastes, or alternatively the combustion of high sulfur fuels such as coal or the like, and has as its overall object the provision of such a furnace capable of performing this operation cleanly and economically, providing a maximum of heat. The cyclonic effect of the furnace is especially designed to minimize the particulate matter escaping through the flue so that the material to be combusted produces a minimum amount of polluting particulate, maximizes the degree of burning of the feedstock material therein, and makes the most efficient use of the sorbent introduced into the device hereof.

2. Description of the Prior Art

A variety of furnaces and kilns have been provided in the past for combusting fuels or waste products to generate heat and/or to pyrolitically alter the feedstock material. In some cases, the furnace or kiln is provided with various air inlets in order to introduce combustion air into the kiln body in an attempt to provide ample combustion air to the site of the burning materials. The hot combustion gases are removed from the kiln through a flue, and invariably a problem is created by the entrainment and emission escape of ash or partially combusted material through the flue. In order to minimize the escape of ash to the atmosphere, it has heretofore been necessary to provide furnaces and kilns with flue gas scrubbers for cleaning the effluent and inhibiting the escape of particulate matter into the atmosphere.

Moreover, certain materials to be combusted have a tendency to generate not only ash and other particulate material as a product of combustion, but also discharge vapors which include sulfur dioxide or hydrochloric acid which, when released to the atmosphere, ultimately fall to earth, producing the undesirable phenomena called "acid rain". Obviously, such byproducts are undesirable, and when materials such as high sulfur coal are burned in a furnace, it may be desirable to introduce a sorbent to react with the sulfur in the coal. Unfortunately, prior sorbent injection systems have not been effective in suspending and distributing sorbent throughout the kiln body for maximum reaction with all of the material to be combusted.

SUMMARY OF THE INVENTION

A principal object of the present invention is thus the provision of a furnace, or a combustion device, whereby more or less finely pulverized waste material or high sulfur fuels such as coal are conveyed through an elongated kiln. Within the interior of the kiln, the combustion occurs while the waste material or fuel is lifted and entrained within a supply of combustion air. Preferably, the particles will thus be relatively widely spaced apart, "fluidized", and the presence of air surrounding each of the particles effectively promotes extremely thorough combustion thereof. The cyclonic combustion of the swirling feedstock material and gases are obtained by inclining the kiln from the horizontal and rotating it on its longitudinal axis, tending to distribute the fuel or waste about the internal periphery of the kiln for maximum surface area exposure to the injected combustion air. The inclined rotating kiln body serves and to convey the waste to the lower end of the kiln by gravity, the waste being introduced at the higher or uppermost end of the kiln. By introducing powerful jets of air into the kiln along generally its entire length, and by directing those jets of air through vents in a generally tangential direction corresponding to the sides of the kiln body and in the direction of rotation of the kiln, the waste or fuel particles are lifted and entrained in a generally toroidal pattern in cross section within the kiln whereby these materials may achieve complete combustion. The rotational speed of the kiln and the force of the air injected through the vents may be adjusted proportionally to provide the most efficient distribution of waste or fuel particles and thus provides the best possible thoroughness and efficiency of the cyclonic combustion device hereof.

Another object of the present invention is the provision of a furnace of the character described in which the waste or fuel particles may be introduced continuously, and in which any supply of auxiliary fuel, such as gas, need be introduced only temporarily in order to initiate self-sustaining combustion. Once initiated, the burning reaction ordinarily becomes spontaneous and self-sustaining, with the newly entering fuel or waste being ignited by the heat generated through the combustion and the burning gases which have been driven off by the waste or fuel previously added and already burning. The intensity and distribution of combustion throughout the body of the kiln yields increased efficiency of combustion and less partially combusted material in the ash, as well as higher efficiencies in the destruction of contaminants in toxic, hazardous and industrial wastes.

When the material to be combusted includes less flammable waste materials, auxiliary fuel may, of necessity, be continuously introduced into the body of the kiln. Such fuel may include natural gas, propane or other fossil fuels with the combustion air, or alternatively introducing pure oxygen together with the combustion air for distribution to any of the desired zones of the kiln where auxiliary combustion resources are required.

A further object of this invention is the provision of a furnace of the character herein described in which the quantity of combustion air delivered to longitudinally successive zones of the kiln may be independently and adjustably varied. Generally, greater quantities of air should be delivered to the higher zones of the kiln, in which very little combustion may have occurred, and the waste is therefor still relatively heavy. The additional volume and velocity of the introduced combustion air may be employed to effectively maintain the desired suspension of the waste or fuel in the toroidal pattern in cross section which is helical through the kiln as hereinabove described. By employing various zones within the kiln, lesser air quantities may be desired in lower zones, where combustion has proceeded to a much greater degree and the waste material is therefore lighter in weight. Accordingly, a different quantity of combustion air may be delivered to these lower zones to enable the proper combination of centrifugal force and supplied combustion air to properly entrain and circulate the feed material throughout the kiln body. Adjustment of the combustion air volume may therefore be made in each zone depending on the character of the waste material being processed, its quantity, and the rotational speed of the kiln.

A still further object is the provision of a furnace of the character described hereinabove having means for injecting an auxiliary fuel, such as natural gas, into any or all zones of the kiln, via the air delivery system. This ability to vary the provision of auxiliary fuel in different zones along the length of the kiln enables the production of more intense heat capable of reducing any remaining unburned waste material, including metal or other normally noncombustible components, to "slag". This more intense heat enables the more efficient pyrolytic destruction and easier disposal thereof. The need for such slagging, and the quality of auxiliary fuel needed, will be determined by the content and nature of the fuel or waste being processed.

It is yet a further object of the present invention to provide a means for introducing a sorbent, such as pulverized limestone, either zonally along the length of the kiln through separate introduction means, and/or through introduction together with the fuel or waste materials to be processed. Various waste materials, such as low grade coal or comminuted automobile tires, may contain a very high sulfur content. When such high sulfur content feedstocks are employed, it is necessary to capture the sulfur dioxide which would otherwise be generated during the combustion process. The inclusion of a sorbent into the cyclonic combustion process within the kiln enables a maximum capture of the sulfur dioxide thus generated and thus minimizes the amount of sulfur dioxide vented through the flue to the atmosphere. Similarly, when certain plastics are to be destroyed, hydrochloric acid is generated, and the sorbent injected through the system thereof may react with the hydrochloric acid to prevent its discharge to the atmosphere.

It is yet another object of the present invention to provide a rotary kiln which maximizes the distribution of the feedstock circumferentially throughout the chamber within the body of the kiln. By providing a tangential air injection system, the feedstock materials within the kiln are lifted and entrained in a cyclonic pattern which yields a helical flow throughout the length of the kiln with the particulate matter being combusted and centrifuged against the sidewall of the kiln, thereby dramatically lowering the particulate entrained with the flue gases while nonetheless enabling the exhaust gases to be discharged through the flue and the slag or ash to be discharged from the kiln body. By distributing the feedstock and sorbent forming a bed within the kiln substantially along the entire interior circumference of the kiln body, the combustion is maintained in a substantially toroidal pattern with the bed being centrifuged and directed by the force of the injected combustion air against the sides of the kiln, the ash is subjected to a maximum exposure to the supplied combustion air and the combustion process within the kiln body. Because the feedstock material is swept along the interior sidewall of the kiln, the flue is oriented radially inwardly and preferably centrally of the kiln body sidewalls to prevent the ash or other particulate material from being swept up and out through the flue by the vortex pattern of the combustion therewithin.

It is yet another object of the present invention to provide a rotary kiln with the ability to precisely control the amount of sorbent introduced therein according to the character of the feedstock material and the quantity and quality of combustion air supplied thereto to maintain the combustion temperature within the kiln in a range of 1,450 degrees Fahrenheit to 1,650 degrees Fahrenheit, and preferably at about 1,550 degrees Fahrenheit for maximum efficiencies in the capture of sulfur from the combusting feedstock materials. This is accomplished by the provisions for multiple injection nozzles for the sorbent to be introduced into zones of the kiln, together with the ability to supply additional combustion air and auxiliary fuel through the combustion air supply system.

With these objects in view, as well as other objects which will appear during the course of the specification, reference will now be had to the accompanying drawing.

DETAILED DESCRIPTION OF THE DRAWING

Figure 1:
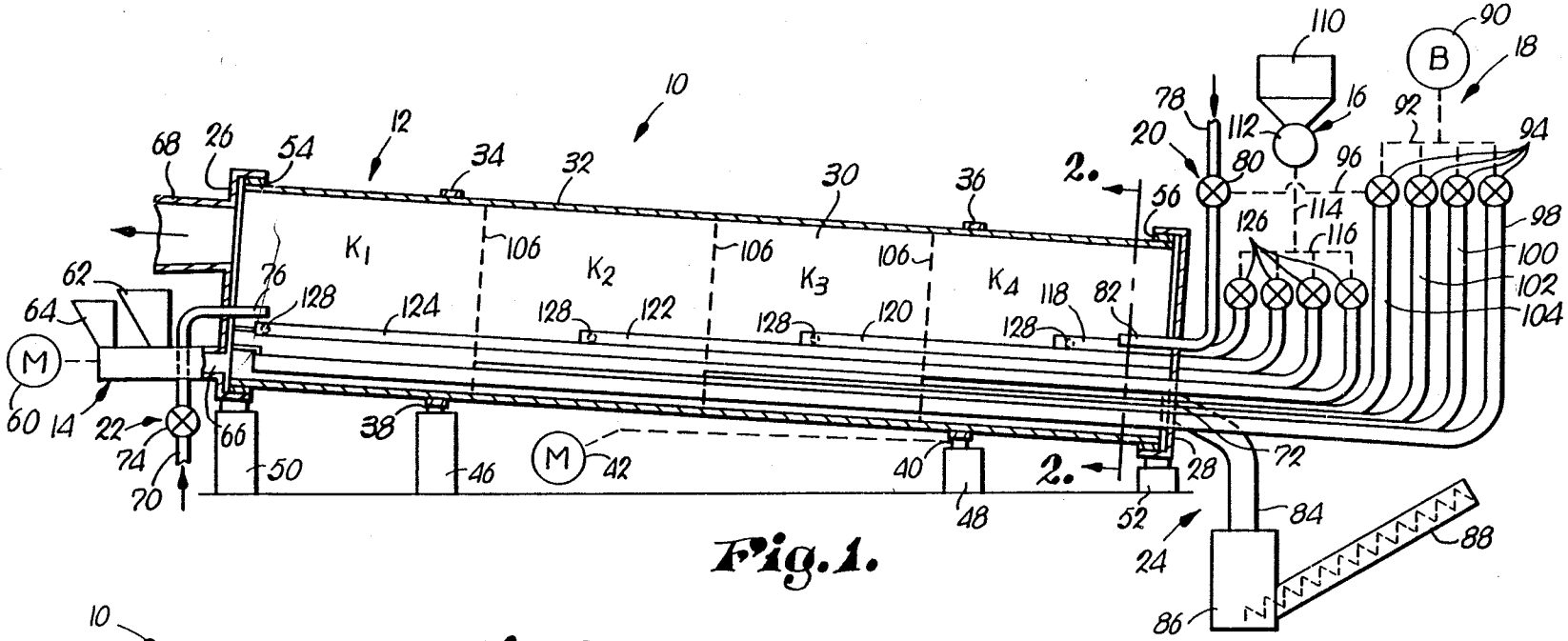
FIG. 1 is a longitudinal sectional view of a furnace embodying the present invention, with portions thereof shown schematically and other parts left in elevation.

Referring now to the drawing, a cyclonic combustion device 10 for pyrolytic destruction and gasification of wastes or alternatively the combustion of high sulfur fuel feedstocks such as coal includes an elongated axially rotatable kiln body 12, a feedstock injection means 14, a sorbent introduction means 16, a combustion air introduction means 18, auxiliary fuel supply means 20, 22 and a processed waste removal means 24. It may be appreciated that inclined kiln body 12 is elevated and inclined whereby a first, uppermost end 26 is elevated with respect to an opposed, second generally lowermost end 28 to define an internal kiln chamber 30 between said uppermost end 26, said lowermost end 28, and cylindrical sidewall 32 of said kiln body 12.

Figure 2:
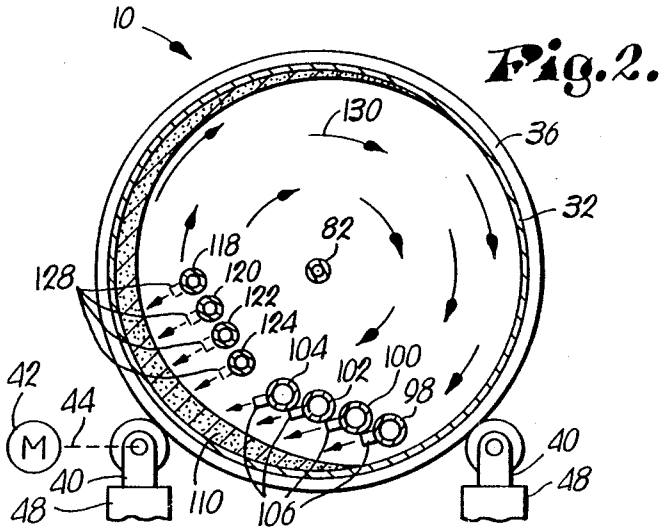
FIG. 2 is an enlarged sectional view taken along line 2—2 of FIG. 1.

In greater detail, kiln body 12 is provided with trunnion bands 34, 36 mounted on the kiln sidewall 32, for rotation on trunnion rollers 38 and 40 respectively. At least one of the trunnion rollers 40 is interconnected to the variable speed motor 42 by appropriate drive means 44, whereby the kiln may be rotated at any desired speed, turning in a clockwise direction as indicated in FIG. 2. It may also be appreciated that trunnion rollers 38 and 40 are supported and elevated upon bases 46, 48 respectively whereby the proper support and angle of inclination may be provided to the kiln body 12.

Yet further, end walls 26 and 28 are similarly supported in a fixed position on bases 50, 52, with seals 54, 56 acting to prevent the leakage of air between sidewalls 32 of kiln body 12 and stationary ends 26 and 28 respectively and which allow rotation of the kiln body 12 thereagainst.

First end 26 is provided with feedstock introduction means 14, which includes a ram or auger feeder 58. The feeder 58 is powered by a variable speed electric motor 60 operatively coupled thereto. feedstock introduction means 14 also includes feedstock hopper 62 and sorbent hopper 64, together with a metering system for the selective introduction of materials into the chamber 30. End 26 is suitably provided with an aperture 66 for the introduction of the feedstock or sorbent therethrough. End 26 is also provided with a flue 68, which is spaced inwardly away from the adjacent cylindrical sidewall 32 and preferably centrally located on end wall 26. Thus, collected ash, feedstock material or sorbent which is lifted and centrifuged against sidewall 32 is prevented from being swept and entrained outwardly through flue 68 by adjacent end wall 26.

Again viewing FIG. 1, it may be seen that end 26 is also provided with auxiliary fuel introduction means 22, which includes a fuel pipe 70 for the introduction of natural gas, propane, or any other readily combustible fuel into the chamber 30 within the kiln body 12. The fuel pipe 70 is provided with a regulating valve 74 for selectively permitting the introduction of such fuel into chamber 30 through nozzle 76 at the opposed end of fuel pipe 70.

Second end 28 is similarly provided with an auxiliary fuel introduction means 20. Auxiliary fuel introduction means 20 includes a fuel pipe 78, regulating valve 80 and nozzle 82 whereby fuel pipe 78 may extend through end wall 28 for providing a source of fuel such as natural gas, propane or the like into chamber 30 through nozzle 82. Second end 28 is also provided with an opening 72 for receiving a discharge conduit 84 for withdrawing ash, slag or uncombusted "clinkers" from the kiln chamber 30. The conduit 84 receives such slag materials by force of gravity, with the slag or ash particles falling through opening 72 into conduit 84 before reaching quencher 86 whereafter they may be transported by an auger conveyer 88 to a subsequent station for disposal or further processing, as desired.

Combustion air supply means 18 includes a blower 90 for generating a positive source of air pressure. Blower 90 discharges air through an appropriate manifold shown schematically by the number 92 to a plurality of regulating valves 94. In some preferred forms, additional tubing 96 may be provided between valve 80 and valves 94 to introduce additional fuel through the combustion air supply means 18.

Air supplied by blower 90 is routed through manifold 92 into valves 94 corresonding to four separate air injection pipes 98, 100, 102 and 104. The air supply to each of these four air injection pipes 98, 100, 102 and 104 is independently controlled by a separate valve 94 for each pipe. Each of the pipes 98, 100, 102 and 104 is suitably apertured to direct a respective supply of combustion air to only one zone K1, K2, K3 and K4 as defined by imaginery lines 105 shown in FIG. 1. That is to say, air injection pipe 98 supplies combustion air through vents only in zone K1, air injection pipe 100 supplies combustion air through vents only in zone K2, air injection pipe 102 supplies combustion air through vents only in zone K3, and air injection pipe 104 supplies combustion air through vents only in zone K4.

Figure 3:
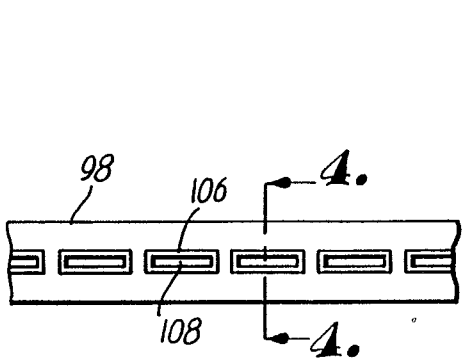
FIG. 3 is an enlarged side elevational view of a section of one of the air injection pipes.
Figure 4:
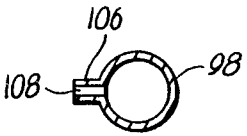
FIG. 4 is a sectional view taken along line 4—4 of FIG. 3.

As shown in FIG. 2, each of the air injection pipes 98, 100, 102 and 104 are provided with air directing vents 106 thereon. The vents are oriented for directing a tangential stream of combustion air along the sidewall 32 of the kiln body 12. Each of the pipes 98–104 are similarly oriented to direct air along parallel chordal planes toward sidewall 32 and arranged in staggered relationship. As shown in FIG. 3, the vents 106 are substantially rectangular in configuration to present a series of slots 108 through which the air passes. The vents 106, functioning as nozzles, are oriented in a common direction, as shown in FIG. 4 and FIG. 2, and are distributed along the pipe so that air passing through slot 108 is directed by vent 106 toward a bed 110 being fluidized of feedstock material which may include a portion of sorbent therein. The pipes 98–104, may be supported by any suitable means, not shown, or may span the length of the kiln body 12 to be suppored by ends 26 and 28.

Sorbent introduction means 16 similarly extends through second, generally lowermost end 28 of kiln body 12. Sorbent introduction means 16 broadly includes a hopper 110 for receiving a quantity of sorbent such as limestone ($CaCO_3$), a blower feeder 112 and pneumatic conduit means 114 extending to a header 116. At header 116, the sorbent is divided to flow into any of four individual sorbent injection pipes 118, 120, 122 and 124. The amount of sorbent directed to each pipe 118, 120, 122 and 124 is independently controlled by separate valves 126 located intermediate header 116 and pipes 118, 120, 122 and 124 respectively. Each sorbent injection pipe 118, 120, 122 and 124 is provided with a separate sorbent nozzle 128 for directing a supply of sorbent to respective zone K4, K3, K2 and K1.

In operation, it may be seen that any of a variety of feedstock materials may be combusted in the cyclonic combustion device hereof. Industrial or municipal waste, hazardous or toxic waste, comminuted tires, low grade (high sulfur) coal or other carbonaceous materials, may be fed continuously into a hopper 62 as feedstock for pyrolytic destruction and gasification. Once the feedstock introduction means 14 generates a sufficient flow of feedstock into the chamber 72, the feedstock is ignited by flame generated by nozzles 76 and 82 when appropriate fuel is deleivered through pipes 70 and 78. Combustion air is supplied to the kiln by pipes 98, 100, 102 and 104 whereby the combustion process may be enhanced.

Once the combustion process within the device 10 hereof is initiated, additional feedstock material is introduced continuously through hopper 64 and the kiln is rotated in a clockwise direction as shown in FIG. 2. The combustion process is increased by the additional supply of combustion air whereby the feedstock within the kiln is lifted and swirled therewithin. As the combustion process increases, a cyclonic "cloud"130 of toroidal or doughnut form is generated within the kiln by the stream of tangentially flowing air injected by pipes 98, 100, 102 and 104 and the rotary action of the axially rotatable kiln body 12. As may be appreciated, various amounts of combustion air may be directed to different zones K1, K2, K3 and K4 as needs admit, as well as additional amounts of auxiliary fuel suppled through conduit 96. As the kiln body rotates, centrifugal forces will tend to disperse the fluidized bed 110 peripherally along the interior of sidewall 32, a phenomena which is enhanced by the tangentially directed air flowing through vents 106 of pipes 98, 100, 102 and 104.

Because the kiln body 12 is inclined, the heavier particles will tend to move in a generally helical direction downward toward lower second end 28, while the lighter particulate matter is combusted in the swirling combustion pattern indicated by the arrows in FIG. 2. Thus, the gaseous material within the kiln tends to flow upstream towards flue 68 where the heat supplied by the flue may be used in a reclamation boiler or the like. However, as the flue 68 is spaced downwardly from the sidewall 32, the heavier fluidized bed 10 will not be directed outwardly through flue 68 but instead will be held within the kiln for ultimate discharge through outlet aperture 72 and conduit 84. Thus, the effluent departing through flue 68 is cleaner as the feedstock particles are exposed to a maximum distribution of the combustion flame and maximum exposure to the combustion air and sorbent.

It may also be appreciated that valves 94 permit appropriate regulation of the amount of combustion air supplied to each of the zones K1 through K4. For example, if full volume of air to zone K1 is maintained, an excessive amount of ash and other solid particulate matter may be carried off at flue 68, which could overload and interfere with the operation of any heat reclamation devices or scrubbers downstream. If full air supplied to zone K4 is maintained, the cyclonic flow pattern caused thereby may interfere with the appropriate collection and discharge of heavy cinders, slag, ash or the like through conduit 84. Therefore, in some cases, it may be desirable to reduce the volume of air supplied to these zones to permit the formation of fluid beds 110 at a downwardly disposed or more reposed position, and to lessen the formation of the cyclonic cloud 130 therein. As mentioned hereinabove, a sorbent such as limestone ($CaCO_3$) may be supplied with the feedstock material by introduction through hopper 64, and also or separately through sorbent introduction system 16. The amount of sorbent to be provided to each of the respective zones K1 through K4 may be individually regulated by valves 126. The introduction of sorbent into, for example, high suflur coal, yields the following reaction when heat and a high sulfur carbonaceous feedstock are exposed to the sorbent: $CaCO_3 \rightarrow CaO + CO_2 \rightarrow CaO + SO_2 + \frac{1}{2}O_2 \rightarrow CaSO_4$. Such materials might include a high sulfur coal or, alternatively, comminuted autmobile tires. By the provision of the separate zones, again it may be appreciated that the amount of sorbent supplied will maximize the efficiency of the operation by ensuring that the appropriate amount of sorbent is supplied according to the combustion air, the nature of the feedstock and heat generated in each of the independent zones of the kiln body 12. The provision for zonal introduction of both combustion air and sorbent, together with the additional capacity for introduction of auxiliary fuel, enables the combustion process to be tightly controlled for maximum sulfur capture and maximum sorbent efficiency. Such efficiencies are conventionally obtained at a temperature of about 1,550 degrees Fahrenheit.

The positive pressure generated by the introduction of sorbent through sorbent introduction means 16, together with the positive air pressure generated by combustion air supply means 18, causes the kiln effluent to be drawn from the kiln body 12 through flue 68 by the draft applied thereto, with the further result that this effluent may also contain only miminal amounts of ash, unburned noxious gases, and unburned solid particulate matter as well as sulfur dioxide. With respect to the uncombusted components, they may be treated by scrubbers, afterburners or the like which are not considered to be a component of the present invention.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cyclonic combustion device comprising:

an elongated kiln body having a cylindrical sidewall and first and second opposed ends defining an internal kiln chamber, said body also presenting a longitudinal axis;

means mounting said kiln with the longitudinal axis thereof inclined whereby said first end is elevated with respect to said second end;

means for selectively axially rotating said kiln body at any one of a number of different rotational speeds;

means operably associated with said first end of said kiln body for introduction of combustible feedstocks into said kiln chamber;

means operably connected with said first end of said kiln body for conveying gases and suspended particulate effluent matter from the kiln chamber;

structure defining an outlet aperture operably associated with said second, lower end for removal of solid material from said kiln chamber;

a plurality of elongated, generally parallel, adjacent pipes situated within said kiln chamber and extending along the length of the kiln body in substantially parallel relationship with but radially offset from said longitudinal axis, each of said pipes including slot-defining means along the length thereof oriented for directing pressurized air from the associated pipe in a generally horizontal chordal plane toward an adjacent section of said cylindrical sidewall, each of said chordal planes being generally parallel, the slot-defining means of each conduit defining and being located within and extending substantially the full length of a respective elongated zone within said chamber, the slot-defining means of said plural pipes collectively extending substantially the full length of said chamber;

means operably coupled with each of said pipes for selectively directing pressurized combustion air thereinto, whereby presurized air exiting from each of said slot-defining means provides pressurized air along essentially the full length of the respective zone;

means for igniting said feedstock after entrance thereof into said kiln chamber; and means for the introduction of sorbent into said kiln chamber, said sorbent introduction means comprising a plurality of sorbent injection pipes extending longitudinally through said kiln body, each of said pipes corresponding to one of said zones and having at least one nozzle for introduction of sorbent into said zone.

2. A cyclonic combustion device as set forth in claim 1, wherein said pipes are vertically disposed below said longitudinal axis such that said slot-defining means are oriented to direct pressurized air into a bed comprising said feedstock introduced into said kiln chamber.

3. A cyclonic combustion device as set forth in claim 2, wherein said slot-defining means include a plurality of individual, substantially horizontally extending, substantially co-planar slots.

4. A cyclonic combustion device as set forth in claim 3, wherein each pipe is provided with air directing means in surrounding relationship to each slot-defining means for directing air transmitted through said slot-defining means along said chordal plane.

5. A cyclonic combustion device as set forth in claim 4, including means for selectively introducing an auxiliary fuel supply through said pipes for augmenting or initiating the combustion process in said chamber.

6. A cyclonic combustion device as set forth in claim 1, wherein said sorbent introduction means further comprises a blower for injecting said sorbent into said pipes.

7. A cyclonic combustion device as set forth in claim 6, including valve means positioned intermediate said blower means and each of said sorbent injection pipes for the selective introduction of sorbent into each of said zones.

8. A cyclonic combustion device as set forth in claim 7, including means for introducing sorbent at said first end of said kiln.

9. A cyclonic combustion device as set forth in claim 1, including means for selectively introducing a sorbent into said chamber along selected zones therewithin for matching the sorbent injection into each zone according to the feedstock and combustion air supplied to the chamber, said feedstock including a quantity of sulfur therein, thereby enabling the temperature within the kiln body to be maintained in a range from about 1,450 degrees Fahrenheit to 1,650 degrees Fahrenheit for maximization of the sulfur capture within the kiln body.

* * * * *